US005919026A

United States Patent [19]

Appleton

[11] Patent Number: 5,919,026

[45] Date of Patent: Jul. 6, 1999

[54] CARRY CAN DISCHARGE FLOOR

[75] Inventor: Andy B. Appleton, Guttenberg, Iowa

[73] Assignee: Kann Manufacturing Corporation, Guttenberg, Iowa

[21] Appl. No.: 08/867,265

[22] Filed: Jun. 2, 1997

[51] Int. Cl.[6] ..... B65F 3/04

[52] U.S. Cl. ..... 414/408; 220/909; 414/411

[58] Field of Search ..... 414/406–409, 414/414, 411, 486, 487, 810, 812; 220/908, 909; 222/556, 559, 561

[56] References Cited

U.S. PATENT DOCUMENTS

| | | | |
|---|---|---|---|
| 2,731,162 | 1/1956 | Walstrom | 414/708 |
| 2,772,919 | 12/1956 | Jones | 414/424 X |
| 2,881,931 | 4/1959 | Mackie | 414/708 |
| 2,990,072 | 6/1961 | Mindrum | 414/708 |
| 3,135,405 | 6/1964 | Wender et al. | 414/408 X |
| 3,195,942 | 7/1965 | Dempster et al. | 414/405 X |
| 3,207,343 | 9/1965 | Ord | 414/406 |
| 3,297,183 | 1/1967 | Klaviter et al. | 414/708 |
| 3,339,769 | 9/1967 | Conrad | 414/707 |
| 3,491,906 | 1/1970 | Davidson | 414/707 |
| 3,519,155 | 7/1970 | Jefferson et al. | 414/701 |
| 3,563,137 | 2/1971 | Graber et al. | 414/700 X |
| 3,576,265 | 4/1971 | Brady et al. | 414/408 X |
| 3,796,792 | 3/1974 | Bromberek | 423/250 |
| 3,811,587 | 5/1974 | Seaberg | 414/700 |
| 3,980,191 | 9/1976 | Schiavone et al. | 414/501 |
| 3,984,017 | 10/1976 | Giles | 414/414 |
| 4,085,858 | 4/1978 | Smith | 414/407 |
| 4,266,900 | 5/1981 | Rynyk | 414/285 |
| 4,363,588 | 12/1982 | Stickney | 414/408 |
| 4,405,278 | 9/1983 | Kvalheim | 414/411 |
| 4,450,828 | 5/1984 | Orker et al. | 414/406 X |
| 4,648,775 | 3/1987 | Verner | 414/408 X |
| 4,921,389 | 5/1990 | O'Daniel | 414/421 X |
| 4,934,896 | 6/1990 | Quinto | 414/408 X |
| 5,059,081 | 10/1991 | Brown et al. | 414/408 |
| 5,094,582 | 3/1992 | Molzhor | 414/408 X |
| 5,201,235 | 4/1993 | Sutton | 414/708 X |
| 5,205,698 | 4/1993 | Mezey | 414/406 |
| 5,316,430 | 5/1994 | Horning et al. | 414/407 |
| 5,368,436 | 11/1994 | Freiburger | 414/408 X |
| 5,413,448 | 5/1995 | Peshkin | 414/406 X |
| 5,599,071 | 2/1997 | Kann et al. | 414/408 X |
| 5,741,107 | 4/1998 | Georg | 414/408 |

FOREIGN PATENT DOCUMENTS

| | | | |
|---|---|---|---|
| 218965 | 4/1987 | European Pat. Off. | 220/908 |
| 577566 | 1/1994 | European Pat. Off. | 414/408 |
| 483112 | 9/1929 | Germany | 414/414 |
| 2455791 | 8/1976 | Germany | 414/406 |
| 3420058 | 12/1985 | Germany | 414/408 |
| 9827 | 1/1979 | Japan | 414/406 |

*Primary Examiner*—David A. Bucci
*Attorney, Agent, or Firm*—Foley & Lardner

[57] ABSTRACT

A method for unloading refuse contained in a container having a bottom discharge door into an interior of a storage body of a refuse collection vehicle having an access opening includes the steps of raising the container above the access opening of the storage body, lowering the container through the access opening to position the bottom discharge door within the interior of the storage body and opening the discharge door to unload refuse from the container into the interior of the storage body. A refuse collection vehicle includes a storage body, an intermediate container and a lift. The storage body has a plurality of walls defining an interior and an access opening. The intermediate container is movably supported adjacent to the storage body and includes a top opening, a bottom, a plurality of walls therebetween defining an interior and a discharge opening adjacent the bottom and at least one door adjacent the bottom for selectively opening and closing the discharge opening. The lift is movably supported adjacent the storage body for raising the intermediate container above the access opening and for lowering the entire container such that the bottom discharge opening nests within the interior of the storage body.

18 Claims, 4 Drawing Sheets

CARRY CAN DISCHARGE FLOOR

FIELD OF THE INVENTION

The present invention relates to methods and apparatus for unloading refuse from containers into a storage body of a refuse collection vehicle. In particular, the present invention relates to a method and apparatus wherein the container has a bottom discharge opening and a door for opening and closing the discharge opening and wherein the container is raised above an access opening of the storage body and lowered such that the bottom discharge opening nests within the interior of the storage body prior to opening the door and unloading refuse from the container into the storage body.

BACKGROUND OF THE INVENTION

Residential, commercial and industrial refuse is typically stored and contained in a variety of receptacles or containers including cans, carts and dumpsters prior to pick-up by a refuse collection vehicle. A refuse collection vehicle used to collect and transport the refuse typically includes a large storage body in which the refuse is aggregated during collection. To reduce the overall time required for handling refuse contained in smaller receptacles or containers such as cans and carts, many refuse collection vehicles are equipped with intermediate containers or "carry-cans" which, when full, are unloaded into the storage body.

To unload the refuse contained in the container, the container is typically lifted and inverted over and above an access opening of the storage body. Alternatively, the container is lifted over and above the access opening, inverted and then lowered through the access opening. Both methods require that the container be inverted over and above the access opening. As the container is inverted, refuse begins to fall out of the container. As a result, the refuse spills over the sides and top of the truck, littering the street or surrounding area. Wind aggravates this problem with lighter refuse such as paper, plastic jugs and grass clippings.

In recent years, communities and states have developed programs for the segregation and collection of recyclable refuse or commodities to minimize consumption of natural resources and the exhaustion of land fills. As a result, the particular types of recyclable refuse must be segregated from other types of recyclable refuse and from non-recyclable refuse. Consequently, storage bodies and intermediate containers of refuse collection vehicles have been compartmentalized to accommodate the need for segregating recyclable and non-recyclable refuse. This compartmentalization of the storage body and the intermediate container has created smaller compartments and correspondingly smaller access openings. Due to spacing requirements, the multiple access openings of the multiple compartments are often located adjacent one another. The smaller access openings as well as the closer proximity of the multiple access openings has further increased the need for precise unloading to avoid not only littering of the surrounding environment but also to avoid cross-contamination of the recyclable and non-recyclable refuse. This need for precise unloading of refuse has been further magnified because a wind now has a larger effect on lighter refuse such as paper, plastic jugs and aluminum cans which are frequently segregated from other larger and heavier refuse. As a result, there is a continuing need for a method and apparatus for precisely unloading refuse from a container into a storage body or the intermediate container of a refuse collection vehicle and for unloading the refuse from the intermediate container into the storage body of the refuse collection vehicle to avoid littering of the surrounding environment and to avoid cross-contamination of segregated refuse.

SUMMARY OF THE INVENTION

The present invention is directed to an improved method and apparatus for unloading refuse from a container into an interior of a storage body of a refuse collection vehicle. In particular, the method is for unloading refuse contained in a container having a bottom discharge door into an interior of a storage body of a refuse collection vehicle. The method includes the steps of raising the container above the access opening of the storage body, lowering the container through the access opening to position the bottom discharge door within the interior of the storage body and opening the discharge door to unload refuse from the intermediate container into the interior of the storage body. In one preferred embodiment, the step of opening the discharge door includes sliding the discharge door to unload refuse from the container.

The apparatus is a refuse collection vehicle for collecting refuse contained in a container having a bottom discharge opening and a door for opening and closing the discharge opening. The vehicle includes a storage body having a plurality of sidewalls defining an interior and an access opening sized for receiving the container, and lift arms movably coupled adjacent the storage body and configured for lifting the container above the access opening and for lowering the entire container such that the bottom discharge opening nests within the interior of the storage body. In one preferred embodiment, the refuse collection vehicle additionally includes leveling means for maintaining the container in a level orientation while the lift arms lift the container above the access opening.

The apparatus is also directed to a refuse collection vehicle including a storage body, an intermediate container and a lift. The storage body has a plurality of walls defining an interior and an access opening. The intermediate container is movably supported adjacent the storage body and includes a top opening, bottom, a plurality of walls therebetween defining an interior and a discharge opening adjacent the bottom, and at least one door adjacent the bottom for selectively opening and closing the discharge opening. The lift is movably coupled adjacent the storage body and is configured for raising the intermediate container above the access opening and for lowering the entire container such that the bottom discharge opening of the container nests within the interior of the storage body. In one preferred embodiment, the discharge door slidably moves so as to open and close the discharge opening. In a more preferred embodiment, the storage body includes a canopy adjacent the access opening for receiving the discharge door.

The apparatus is also directed to a refuse collection vehicle including a storage body having a plurality of walls defining a first compartment having a first interior, a second compartment having a second interior and an access opening in communication with the first and second interiors, an intermediate container movably supported adjacent the storage body and a lift for raising the intermediate container. The intermediate container includes a top opening, a bottom, a plurality of walls therebetween defining a first bin having a first discharge opening adjacent the bottom, a second bin having a second discharge opening adjacent the bottom and at least one door adjacent the bottom for selectively opening and closing the discharge openings. The lift moves the intermediate container through the access opening such that the discharge openings nest within the interior of the storage body in alignment with the first and second compartments, respectively.

In yet another embodiment, the intermediate container includes at least one partition dividing the interior of the intermediate container into a first plurality of compartments. The storage body includes a second plurality of compartments corresponding to the first plurality of compartments. Adjacent compartments of the second plurality of compartments are separated by an alignment guide. Each slot of the intermediate container receives a corresponding alignment guide when the bottom of the intermediate container is lowered so as to nest within the interior of the storage body.

DETAILED DESCRIPTION OF THE PREFERRED EMBODIMENTS

Figure 1:
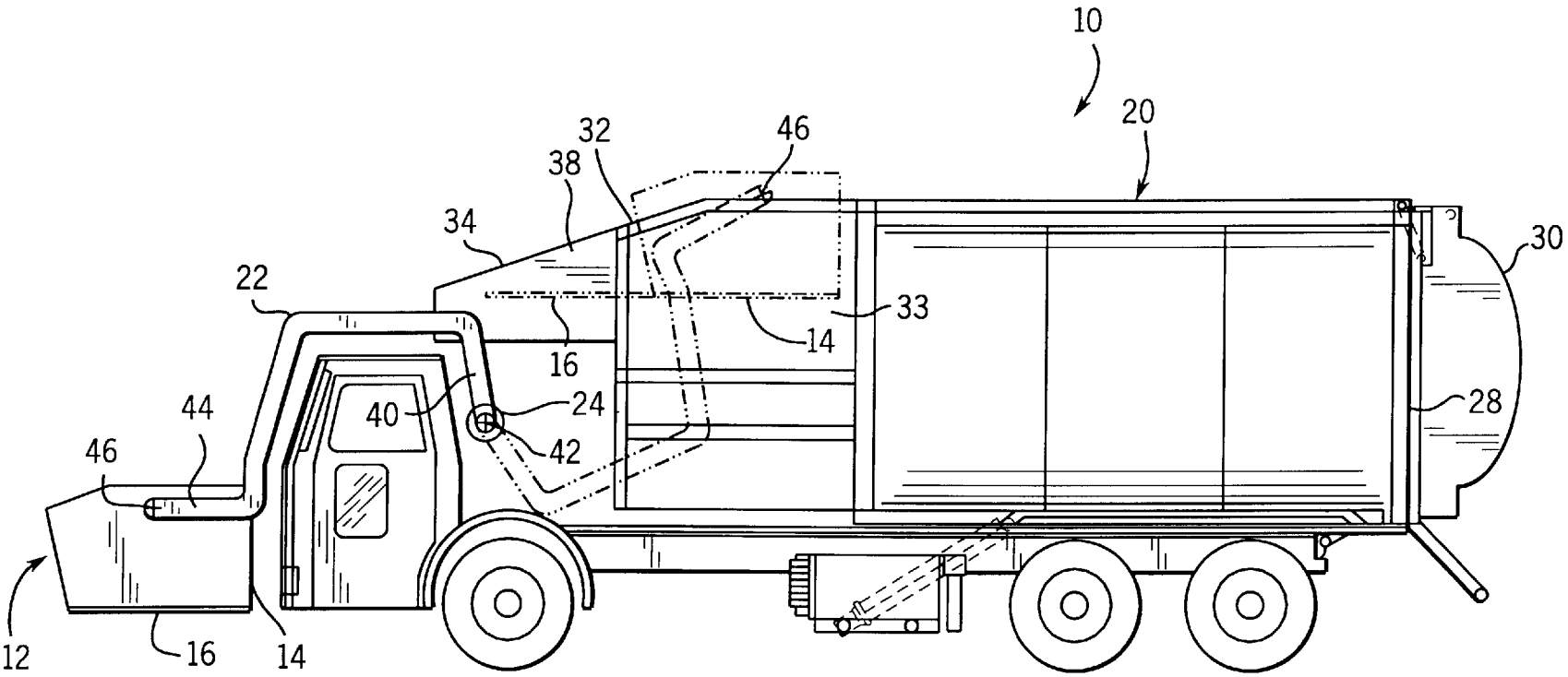
FIG. 1 is a side elevational view of a refuse collection vehicle supporting a container during both loading of the container and unloading of the container into the vehicle.
Figure 2:
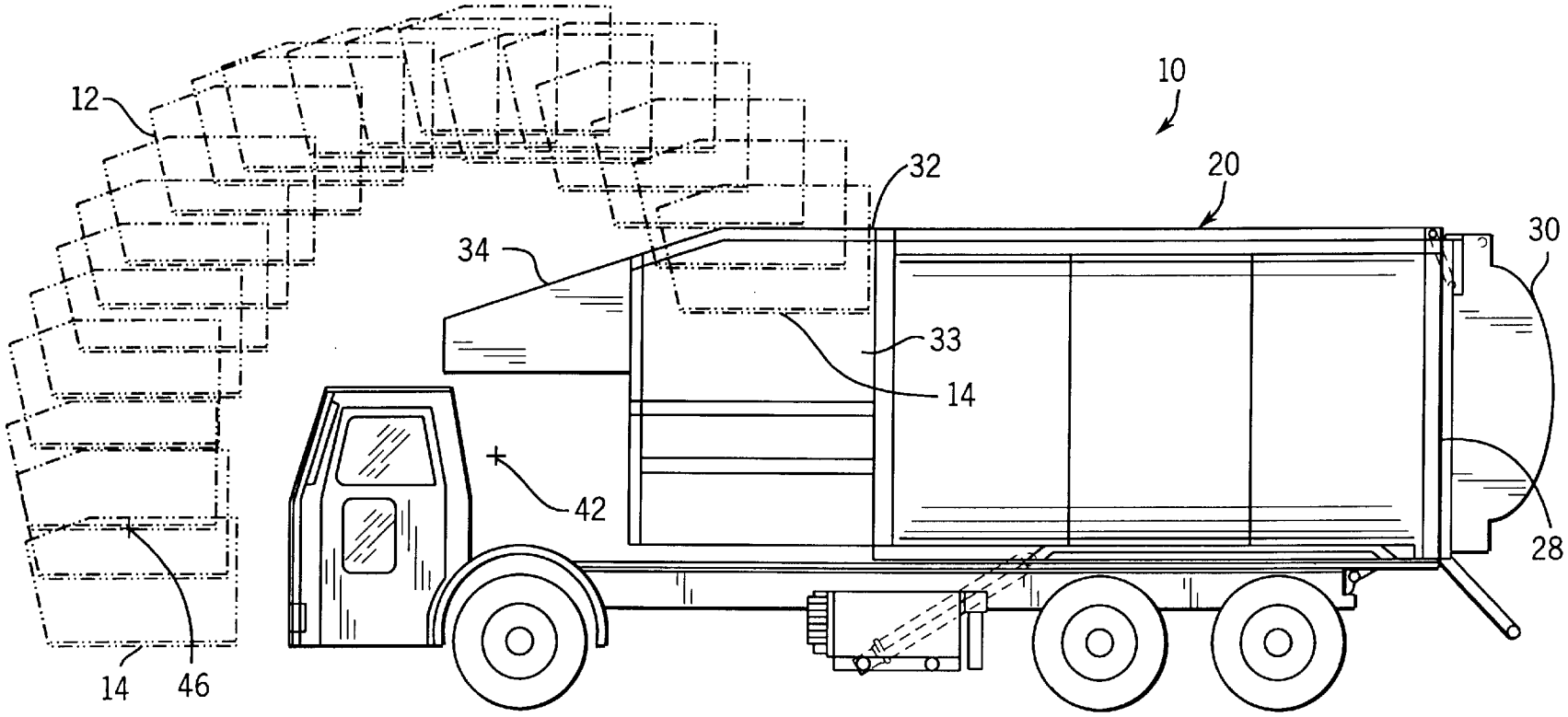
FIG. 2 is a side elevational view schematically illustrating orientations of the container while the refuse collection vehicle elevates the container above an access opening of the vehicle and while the vehicle lowers the container through the access opening of the vehicle.

FIGS. 1 and 2 illustrate refuse collection vehicle 10 supporting container 12 during loading and unloading of container 12. FIG. 1 is a side elevational view of refuse collection vehicle 10 illustrating container 12 supported in front of vehicle 10 and further illustrating container 12 nested partially within vehicle 10 for unloading. FIG. 2 schematically illustrates the orientation of container 12 as container 12 is elevated above and lowered into vehicle 10. Container 12 is configured for being engaged and carried by refuse collection vehicle 10 and includes at least one bottom discharge opening 14 through which refuse contained within container 12 is emptied. Container 12 additionally includes at least one bottom discharge door 16 for selectively opening and closing discharge opening 14.

Refuse collection vehicle 10 lifts container 12 to unload the contents of container 12 into vehicle 10. Refuse collection vehicle 10 generally includes storage body 20 and lift actuators 24. Storage body 20 is conventionally known and is configured for containing refuse, recyclable commodities, or a segregated combination thereof during collection and transport. As is conventionally known, storage body 20 includes a rear discharge opening 28, a rear discharge door 30, a top access opening 32 and a canopy 34. Rear discharge opening 28 is generally located at a rear of storage body 20 and is sized for unloading refuse from storage body 20 at a disposal or recycling facility. Discharge door 30 is supported by storage body 20 adjacent discharge opening 28 and is configured for closing discharge opening 28. As can be appreciated, the size and configuration of storage body 20 may be varied depending upon the particular configuration of refuse collection vehicle 10.

Access opening 32 is defined along a top horizontal surface of storage body 20 and is sized for receiving container 12. In the preferred embodiment illustrated, refuse collection vehicle 10 is a front loading refuse collection vehicle. Accordingly, access opening 32 is located towards a front end of refuse collection vehicle 10. Alternatively, access opening 32 may be positioned towards a rear of refuse collection vehicle 10 or towards a side of refuse collection vehicle 10 for rear and side loading refuse collection schemes, respectively. Access opening 32 communicates with an interior 33 of storage body 20 for loading refuse from container 12 into the interior.

Canopy 34 is a generally elongate hood extending forward and adjacent to access opening 32 towards a front end of refuse collection vehicle 20. Canopy 34 preferably defines a generally hollow cavity 38 in communication with the interior storage body 20. Canopy 34 encloses and protects the front end of refuse collection vehicle 10. In addition, canopy 34 aerodynamically reduces wind resistance of storage body 20.

Lift arms 22 are generally elongate members having a first end 40 pivotally connected to refuse collection vehicle 10 about pivot 42 and a second end 44 pivotally coupled to container 12 about pivot 46. In the preferred embodiment illustrated, end 44 of each of arms 22 is pivotally coupled to container 12 above a center of gravity of container 12 towards a top end of container 12. Arms 22 are pivotally coupled to container 12 along opposite sides of container 12 so as to permit container 12 to pivot between arms 22 to maintain container 12 in a substantially level or horizontal orientation as arms 22 are pivoted about pivot 42 by lift actuator 24.

Lift actuator 24 preferably comprises a hydraulic rotary actuator assembly coupled between refuse collection vehicle 10 and lift arm 22. Actuator 24 pivots arms 22 about pivot 42 so as to elevate container 12 over canopy 34 and above access opening 32. As shown by FIG. 1, actuator 24 further pivots arms 22 so as to lower container 12 through access opening 32 into the interior of storage body 20. Actuator 24 may alternatively comprise other well known pneumatic, electrical, hydraulic or mechanical actuating mechanisms for pivoting lift arms 22 about pivot 42 so as to elevate container 12 above access opening 32 and so as to further lower container 12 through access opening 32 into a nested relationship within storage body 20.

As schematically illustrated by FIG. 2, container 12 pivots about pivot 46 while actuator 24 simultaneously pivots arms 22 about pivot 42. Consequently, refuse collection vehicle 10 maintains container 12 in a substantially level orientation at all times while container 12 is being lifted over and above access opening 32 and while container 12 is being lowered through access opening 32 into the interior of storage body 20. As a result, refuse is maintained within container 12 to minimize spillage. Because arms 22 are pivotally coupled to container 12 directly above the center of gravity of container 12, container 12 pivots about pivot 46 under the force of gravity to maintain its substantially level orientation while being lifted and lowered over and into storage body 20. Consequently, other complex and expensive leveling mechanisms are not needed. Alternatively, refuse collection vehicle 10 may be provided with a slave hydraulic system or a linkage for maintaining the level orientation of container 12.

As shown by FIG. 1, once container 12 is lowered through access opening 32 into the interior of storage body 20, bottom discharge door 16 is selectively actuated so as to open discharge opening 14 to release the contents of container 12 into storage body 20. Because refuse collection vehicle 10 lowers container 12 through access opening 32 such that discharge opening 14 and substantially the entire bottom portion of container 12 is surrounded by at least one vertical wall, refuse released from container 12 must fall into storage body 20. Moreover, the vertical walls surrounding discharge opening 14 on substantially all sides prevent wind from carrying lighter weight refuse away from access opening 32. Consequently, refuse collection vehicle 10 minimizes littering of the surrounding environment.

In addition to providing for more reliable unloading of container 12, refuse collection vehicle 10 improves driving visibility as well as vehicle maneuverability. During transportation of refuse collection vehicle 10 from collection site to collection site or from a collection site to a recycling or disposal site, arms 22 support and maintain container 12 in a nested relationship within storage body 20. Because container 12 is not supported forward of refuse collection vehicle 20, driver visibility is improved. At the same time, because container 12 nests within storage body 20, container 12 does not substantially increase the clearance height of refuse collection vehicle 10. Consequently, the vertical height of storage body 20 may be maximized without impairing the ability of refuse collection vehicle 10 to travel and operate in height restricted areas such as beneath low bridges.

Figure 3:
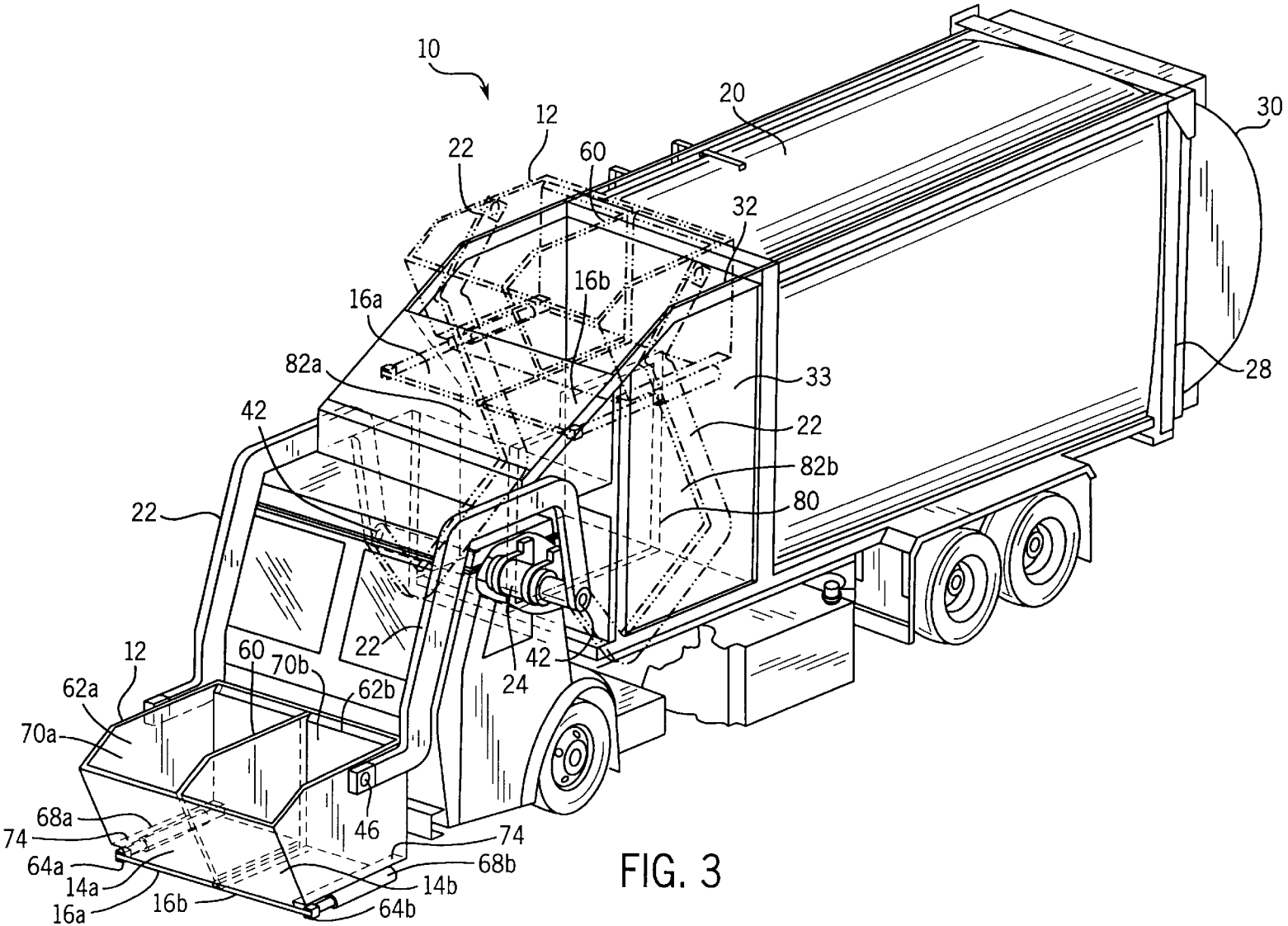
FIG. 3 is a perspective view illustrating the refuse collection vehicle and the container in greater detail.

FIG. 3 is a perspective view illustrating refuse collection vehicle 10 and container 12 in greater detail as container 12 is lifted by lift arms 22 above access opening 32 and lowered through access opening 32 into the interior of storage body 20. As best shown by FIG. 3, container 12 preferably includes divider panel 60, bins 62*a* and 62*b*, discharge openings 14*a* and 14*b*, discharge doors 16*a* and 16*b*, and door actuators 68*a* and 68*b*. Divider panel 60 is a generally vertical wall supported within container 12 so as to partition container 12 into side-by-side bins 62*a* and 62*b*. In the preferred embodiment illustrated, divider panel 60 mates with a corresponding divider panel 80 when container 12 is lowered through access opening 32. Alternatively, divider panel 60 may include an elongate slot extending within divider panel 60 between bins 62*a* and 62*b* so as to receive divider panel 80 when container 12 is lowered through access opening 32. In such an alternative embodiment, the elongate slot enables container 12 to be lowered a greater distance through access opening 32 and further insures against cross contamination of segregated refuse.

Each bin 62*a* and 62*b* defines a top load opening 70*a* and 70*b*, respectively. Load openings 70*a* and 70*b* enable refuse to be easily deposited into bins 62*a* and 62*b*. Discharge openings 14*a* and 14*b* generally extend opposite discharge openings 70*a* and 70*b*, and extend on opposite sides of divider panel 60. Load openings 14*a* and 14*b* are each selectively opened and closed by actuation of discharge doors 16*a* and 16*b* by door actuators 68*a* and 68*b*. Alternatively, doors 16*a* and 16*b* may be interconnected by a link such that load openings 14*a* and 14*b* may be simultaneously open and closed with one door actuator.

Discharge doors 16*a* and 16*b* are generally flat, horizontally extending panels supported adjacent to and below discharge openings 14*a* and 14*b* by guides 64*a* and 64*b*, respectively. Doors 16*a* and 16*b* are sized and shaped for closing and opening discharge openings 14*a* and 14*b* upon being selectively actuated by door actuators 68*a* and 68*b*. In the preferred embodiment illustrated, doors 16*a* and 16*b* slide within guides 64*a* and 64*b*, respectively, to open and close discharge openings 14*a* and 14*b*, respectively.

Guides 64*a* and 64*b* slidably support discharge doors 16*a* and 16*b* below bins 62*a* and 62*b*. Guides 64*a* and 64*b* preferably comprise an elongate, inwardly facing C-shaped tracks longitudinally extending on opposite sides of each discharge opening 14*a* and 14*b*, respectively. Guides 64*a* and 64*b* are sized for slidably receiving an edge of discharge doors 16*a* and 16*b*.

Door actuators 68*a* and 68*b* are fixedly coupled between container 12 and discharge doors 16*a* and 16*b*, respectively. Actuators 68*a* and 68*b* selectively reciprocate doors 16*a* and 16*b* along guides 64*a* and 64*b* so as to open and close discharge openings 14*a* and 14*b* of bins 62*a* and 62*b*. Actuators 68*a* and 68*b* are preferably housed by an above shield or hood 74. In the preferred embodiment illustrated, door actuators 68*a* and 68*b* comprise conventional hydraulic cylinder assemblies. Alternatively, door actuators 68*a* and 68*b* may comprise other linear actuating mechanisms such as pneumatic, electrical or mechanical devices.

As further shown by FIG. 3, storage body 20 preferably includes a vertically extending divider panel 80 supported within the interior of storage body 20 below access opening 32. Divider panel 80 partitions the interior storage body 20 below access opening 32 into two side-by-side loading chutes 82*a* and 82*b* below access opening 32. Chutes 82*a* and 82*b* are positioned below access opening 32 so as to receive refuse from bins 62*a* and 62*b* of container 12 after container 12 has been lowered through access opening 32 and after discharge doors 16*a* and 16*b* have been opened by actuation of actuators 68*a* and 68*b*. Chutes 82*a* and 82*b* communicate with rearward compartments of storage body 20.

As shown by FIG. 3, once lift arms 22 elevate container 12 above access opening 32 and lower container 12 through access opening 32 into the interior of storage body 20, actuators 68*a* and 68*b* slide discharge doors 16*a* and 16*b* within tracks 64*a* and 64*b* towards and within cavity 38 of canopy 34 to open discharge openings 14*a* and 14*b*. As a result, track 64*a* and 64*b* securely support discharge doors 16*a* and 16*b* as discharge doors 16*a* and 16*b* are moved into cavity 38. Once discharge doors are within cavity 38, canopy 34 covers and protects the moving elements of container 12.

Moreover, once discharge doors 16*a* and 16*b* are positioned within cavity 38 to open discharge openings 14*a* and 14*b*, refuse contained within bins 62*a* and 62*b* falls through discharge openings 14*a* and 14*b* into load chutes 82*a* and 82*b*. Because discharge doors 16*a* and 16*b* slide into cavity 38 of canopy 34, discharge doors 16*a* and 16*b* do not require space below discharge openings 14*a* and 14*b* to open discharge openings 14*a* and 14*b*. As a result, interior 33 of storage body 20 may be more completely filled with refuse without interfering with the opening of discharge doors 16*a* and 16*b*. Although discharge doors 16*a* and 16*b* are illustrated as being simultaneously opened so as to simultaneously release refuse into storage body 20, actuators 68*a* and 68*b* may alternatively be selectively actuated so as to only release refuse from one of bins 62*a* and 62*b*.

Figure 4:
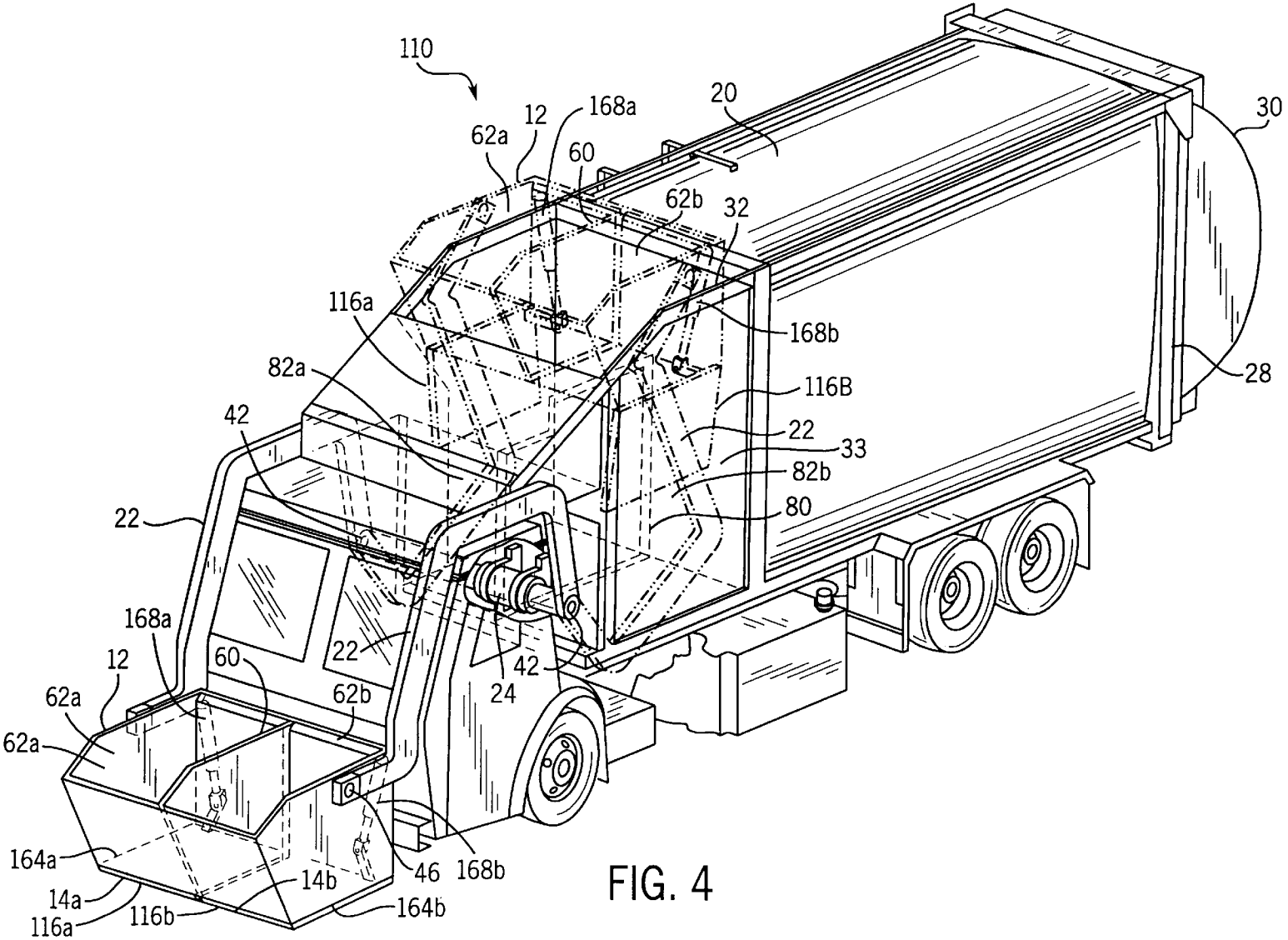
FIG. 4 is a perspective view of an alternate embodiment of the refuse collection vehicle and the container during loading of the container and during unloading of the container into the vehicle.

FIG. 4 is a perspective view of refuse collection vehicle 110, an alternate embodiment of refuse collection vehicle 10 illustrated in FIGS. 1–3. Refuse collection vehicle 110 is similar to refuse collection vehicle 10 except that refuse collection vehicle 110 includes discharge doors 116*a* and 116*b*, hinges 164*a* and 164*b* and actuators 168*a* and 168*b* in lieu of doors 16*a* and 16*b*, guides 64*a* and 64*b* and actuators 68*a* and 68*b*, respectively. For ease of illustration, those remaining elements of refuse collection vehicle 110 which are the same as corresponding elements of refuse collection vehicle 10 are numbered similarly. As shown by FIG. 4, discharge doors 116*a* and 116*b* are similar to discharge doors 16*a* and 16*b* except that discharge doors 116*a* and 116*b* are pivotally coupled to container 12 by hinges 164*a* and 164*b*, respectively. In the preferred embodiment illustrated, hinges

164*a* and 164*b* extend along outermost side walls of bins 62*a* and 62*b*, respectively, such that upon being selectively pivoted by actuators 168*a* and 168*b*, discharge doors 116*a* and 116*b* pivot outwardly away from divider panel 60 of container 12 and away from divider panel 80 of storage body 20. Alternatively, hinges 164*a* and 164*b* may be supported along divider panel 60 or along either a front wall or rear wall of container 12 adjacent discharge openings 14*a* and 14*b* so as to pivotally support discharge doors 116*a* and 116*b* adjacent discharge openings 14*a* and 14*b*, respectively. Furthermore, in lieu of discharge doors 116*a* and 116*b* each compromising a single panel pivotally supported by a single hinge, discharge doors 16*a* and 16*b* may alternatively each comprise a pair of doors pivotally supported opposite one another by a pair of hinges below each refuse bin.

Actuators 168*a* and 168*b* are fixedly coupled between container 12 and discharge doors 116*a* and 116*b*, respectively. Actuators 168*a* and 168*b* selectively pivot discharge doors 116*a* and 116*b* about hinges 164*a* and 164*b* to selectively open and close discharge openings 14*a* and 14*b*, respectively. In the preferred embodiment illustrated, actuators 168*a* and 168*b* comprise conventionally known hydraulic cylinder assemblies. Alternatively, actuators 168*a* and 168*b* may comprise other well known actuating mechanisms including pneumatic, electrical and mechanical actuating mechanisms.

As further shown by FIG. 4, once arms 22 elevate container 12 above access opening 32 and lower container 12 through access opening 32 into the interior of storage body 20, actuators 168*a* and 168*b* are actuated so as to pivot discharge doors 116*a* and 116*b* about the axes of hinges 164*a* and 164*b* so as to open discharge openings 14*a* and 14*b* to release refuse within bins 62*a* and 62*b* into load chutes 82*a* and 82*b*, respectively. As a result, similar to refuse collection vehicle 10, refuse collection vehicle 110 enables refuse within container 12 to be easily unloaded into storage body 20 while preventing cross contamination of refuse within bins 62*a* and 62*b* and also while preventing the refuse from missing access opening 32 entirely. Consequently, refuse collection 110 minimizes cross contamination of segregated refuse and littering of the surrounding environment.

Although the present invention has been described with reference to preferred embodiments, workers skilled in the art will recognize that changes may be made in form and detail without departing from the spirit and scope of the invention.

What is claimed is:

1. A refuse collection vehicle for collecting refuse contained in a container having a bottom discharge opening defined by a first plurality of wall edges surrounding the discharge opening and a door for opening and closing the discharge opening, the vehicle comprising:

a storage body having a plurality of walls defining an interior and an access opening sized for receiving the container, wherein the access opening is defined by first, second, and third walls having a first plurality of edges extending in a plane and a fourth wall having an edge located below said plane, said first, second, third and fourth walls forming an access opening an access opening at a level of said fourth wall edge; and lift arms connected to the container and movably coupled adjacent the storage body, wherein the lift arms move between a first position at which the first plurality of wall edges of the container extend above the plane and a second position at which the first plurality of wall edges of the container extend below the access opening such that the bottom discharge opening nests within the interior of the storage body.

2. The vehicle of claim 1 including:

leveling means coupled to the lift arms for maintaining the container in a level orientation as the lift arms lift and lower the container.

3. The vehicle of claim 1, wherein the storage body includes a canopy adjacent the access opening, wherein the canopy includes an open cavity located to receive the discharge door.

4. A refuse collection vehicle comprising:

a storage body having a plurality of walls defining an interior and an access opening;

an intermediate container movably supported adjacent the storage body, the intermediate container having a top opening, a bottom, a plurality of walls therebetween defining an interior and a discharge opening adjacent the bottom, and at least one door adjacent the bottom for selectively opening and closing the discharge opening; and a lift for raising the intermediate container above the access opening and for lowering the entire container such that the bottom discharge opening nests within the interior of the storage body.

5. The vehicle of claim 4, wherein the discharge door slidably moves so as to open and close the discharge opening.

6. The vehicle of claim 5, wherein the storage body includes a canopy adjacent the access opening, wherein the canopy includes an open cavity located to receive the discharge door.

7. The vehicle of claim 4, wherein the intermediate container includes:

at least one partition dividing the interior of the intermediate container into a first plurality of bins having a corresponding plurality of discharge openings, said at least one door selectively opening and closing the discharge openings.

8. The vehicle of claim 7, wherein each compartment of the first plurality of compartments has a discharge door adjacent the corresponding discharge opening.

9. A vehicle of claim 4 including:

leveling means coupled to the lift for maintaining the container in a level orientation as the lift lifts and lower the container.

10. A refuse collection vehicle comprising:

a storage body having a plurality of walls defining a first compartment having an interior, a second compartment having an interior and an access opening in communication with the interiors of both the first compartment and the second compartment, wherein the access opening is defined by first, second, and third walls having a first plurality of edges extending in a plane and a fourth wall having an edge located below said plane, said first, second, third, and fourth walls forming an access opening at a level of said fourth wall edge;

an intermediate container movably supported adjacent the storage body, the intermediate container having a top opening, a bottom, a plurality of walls therebetween defining a first bin having a first discharge opening defined by a second plurality of wall edges surrounding the first discharge opening, a second bin having a second discharge opening defined by a third plurality of wall edges surrounding the second discharge opening, and at least one door adjacent the bottom for selectively opening and closing the first and second discharge openings; and a lift connected to the intermediate container, wherein the lift moves the container from a first position at which the second and third plurality of wall edges extend on a first side of the plane; to a second position at which the second and third plurality of wall edges extend through the access opening such that the first and second discharge openings nest within the storage body in alignment with the first and second compartments, respectively.

11. The vehicle of claim 9 wherein the lift raises the intermediate container above the access opening and lowers the container through the access opening.

12. The vehicle of claim 9, wherein the discharge door slidably moves so as to open and close the discharge opening.

13. The vehicle of claim 12, wherein the storage body includes a canopy adjacent the access opening, wherein the canopy includes an open cavity located to receive the at least one discharge door.

14. A vehicle of claim 9 including:

leveling means coupled to the lift for maintaining the container in a level orientation as the lift lifts and lower the container.

15. A method for unloading refuse from a container having a discharge opening defined by a first plurality of wall edges surrounding the discharge opening, and a bottom discharge door closing the discharge opening into an interior of a storage body of a refuse collection vehicle having an access opening defined by first, second, and third walls having a first plurality of edges extending in a plane and a fourth wall having an edge located below said plane, said first, second, third, and fourth walls forming an access opening at a level of said fourth wall edge, the method comprising:

raising the container above the plane;

lowering the container through the access opening to position the first plurality of wall edges defining the discharge opening within the interior of the storage body; and opening the discharge door to unload refuse from the container into the interior of the storage body.

16. The method of claim 8 wherein the step of opening the discharge door to unload refuse includes:

sliding the discharge door to unload refuse from the container into the interior of the storage body.

17. The method of claim 15 including:

leveling the container as the container is raised to above the access opening.

18. A refuse collection vehicle for collecting refuse contained in a container having a bottom discharge opening defined by a first plurality of wall edges surrounding the discharge opening and a door for opening and closing the discharge opening, the vehicle comprising:

a storage body having a plurality of walls defining an interior and an access opening sized for receiving the container, wherein the access opening is defined by a second plurality of wall edges surrounding the access opening and extending in a plane;

lift arms adapted to be connected to the container and movably coupled adjacent the storage body, wherein the lift arms move between a first position at which the first plurality of wall edges of the container extend above the plane of the access opening and a second position at which the first plurality of wall edges of the container extend below the plane of the access opening such that the bottom discharge opening nests within the interior of the storage body;

and the storage body including a canopy adjacent the access opening, wherein the canopy includes an open cavity located to receive the discharge door.

* * * * *